US010234123B1

(12) United States Patent
Wang et al.

(10) Patent No.: US 10,234,123 B1
(45) Date of Patent: Mar. 19, 2019

(54) LED TUBE APPARATUS EQUIPPED TO EFFECTIVELY DISSIPATE HEAT IN ABNORMAL SITUATIONS

(71) Applicant: XIAMEN ECO LIGHTING CO. LTD., Xiamen (CN)

(72) Inventors: Qiyuan Wang, Xiamen (CN); Yongjun Bao, Xiamen (CN); Wengui Wu, Xiamen (CN); Qi Liu, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 15/962,839

(22) Filed: Apr. 25, 2018

(51) Int. Cl.

| | |
|---|---|
| ***F21K 99/00*** | (2016.01) |
| ***F21V 15/015*** | (2006.01) |
| ***F21V 23/02*** | (2006.01) |
| ***F21V 25/10*** | (2006.01) |
| ***F21K 9/272*** | (2016.01) |
| ***F21K 9/275*** | (2016.01) |
| ***F21V 29/70*** | (2015.01) |
| ***F21V 29/60*** | (2015.01) |
| *F21Y 103/10* | (2016.01) |
| *F21Y 115/10* | (2016.01) |

(52) U.S. Cl.
CPC ..... *F21V 25/10* (2013.01); *F21K 9/272* (2016.08); *F21K 9/275* (2016.08); *F21V 29/60* (2015.01); *F21V 29/70* (2015.01); *F21Y 2103/10* (2016.08); *F21Y 2115/10* (2016.08)

(58) Field of Classification Search
CPC ..... F21V 25/10; F21V 29/60; F21V 29/70; F21K 9/275; F21K 9/272; F21Y 2115/10; F21Y 2103/10
USPC ..... 313/45
See application file for complete search history.

(56) References Cited

U.S. PATENT DOCUMENTS

| | | | | |
|---|---|---|---|---|
| 4,912,371 | A * | 3/1990 | Hamilton | H05B 41/2325 315/121 |
| 2010/0253226 | A1* | 10/2010 | Oki | F21V 3/00 315/113 |
| 2011/0267809 | A1* | 11/2011 | Kuehnert | H01R 13/113 362/217.14 |
| 2016/0215936 | A1* | 7/2016 | Jiang | F21V 29/83 |

* cited by examiner

*Primary Examiner* — Tracie Y Green
(74) *Attorney, Agent, or Firm* — Chun-Ming Shih

(57) ABSTRACT

An LED tube apparatus has a tube body with two opposite ends fixed to a first cap and a second cap. An LED module is placed in the tube body. The LED module has a driver circuit containing an electronic ballast that generates high frequency electric current. The first cap has two first metal pins to be inserted in a first socket end of a light tube bracket. The first metal pin clutches an end of a leading wire. The leading wire has a protective portion breaking off when the first metal pin is applied with a predetermined range of heat generated by the high frequency electric current when the LED tube apparatus is not operated properly.

20 Claims, 6 Drawing Sheets

LED TUBE APPARATUS EQUIPPED TO EFFECTIVELY DISSIPATE HEAT IN ABNORMAL SITUATIONS

FIELD OF INVENTION

The present invention is related to an LED tube apparatus and more particularly related to an LED tube apparatus capable of handling abnormal situation.

BACKGROUND

Light tube apparatuses are widely used in our daily life. Light tube apparatuses are usually installed to corresponding light tube brackets for connecting to an external power supply like a 110V~220V power source. There are several standards for defining common light tube brackets for matching different light tubes. For example, T8 light tube is a widely used standard and many places are already installed with corresponding light tube brackets.

Traditional fluorescent light tubes have limited life span. Meanwhile, their luminous efficacy is also not perfect, compared with LED light tubes. Therefore, LED light tubes, when their manufacturing cost is decreasing, are widely used to replace traditional fluorescent tubes.

On the other hand, while considering compatibility of traditional fluorescent light tubes, it would be usually more convenient to design an LED tube that can be directly installed in various settings. For example, users may want to buy an LED light tube from a store and would like to install the LED tube directly to a light tube bracket originally designed for fluorescent light tubes. But, there are various aspects to improve LED light tubes to make such products more reliable and convenient by solving various technical problems.

In such crowded field, it is very beneficial to find out innovative design that may satisfy human needs more perfectly, particularly light tubes are so widely used in daily life.

SUMMARY OF INVENTION

According to an embodiment of the present invention, an LED tube apparatus includes a first cap, a second cap, two first pins, a tube body and an LED module.

The two first pins are riveted on a first top surface the first cap for inserting into a corresponding first socket end of a light tube bracket. At least one of the first metal pins clutches a first end of a leading wire. For example, both the first metal pins separately clutches first ends of leading wires. The configuration may also be applied to the second cap and corresponding second metal pins.

The first metal pins may be made of a metal sheet that is folded as a metal tube. A position of the metal tube may be pressed to seize a part of the leading wire to electrically be connected to the leading wire and to fix the leading wire. In some other embodiments, welding or glues may be used for clutching and fixing the metal pins to the leading wires.

The tube body has two opposite ends respectively fixed to the first cap and the second cap for providing an elongated containing space. For example, the tube body is an elongated round tube made of glass, or the tube body is an elongated round tube made of transparent or translucent plastic material like PC. The first cap and the second cap may be made of plastic material.

The LED module is stored in the elongated containing space for emitting light through a surface of the tube body.

The surface of the tube body may be further covered with painting material for light diffusion, preventing glare or for coloring. Fluorescent material may also be used for changing output spectrum of the LED tube apparatus. For example, blue light emitted from LED chips may be converted to green or red light by adding fluorescent material on internal surface of the tube body.

Some heat dissipation material may also be applied on the internal surface of the tube body, particularly when the tube body is made of plastic material, which may be less expensive but may not have well heat dissipation characteristic like glass material. In such case, applying heat dissipation material on internal surface of the tube body may be helpful for enhancing heat dissipation.

The LED module has a driver circuit and an LED array. The driver circuit converts external power source like 110V~220V 50 Hz external current to a driving current supplied to the LED array. The LED array may include multiple LED chips packaged on a transparent substrate, mounted on an aluminum substrate, or any other configuration for emit light passing through the surface of the tube body. More than two types of LED chips with different color temperatures or different colors may be integrated for providing a desired mixed spectrum.

The driver circuit may be mounted on one circuit board, two or more than two circuit boards. In other words, the components of the driver circuit may be distributed in the same place, e.g. near the cap, to prevent affecting light output, or several places. The components of the driver circuit may be placed on the same substrate of the LED chips, or the components of the driver circuit may be kept a distance from the LED chips for meeting different design needs. Components of the driver circuit that generate more heat may be placed closer to the cap for preventing damage of the LED chips. Certain heat sink may be used particularly for components of the driver circuit that generates more heat than other components.

The driver circuit may have two or more external ends for receiving external power source supply. For example, the driver circuit includes an external end connected to a second end of the leading wire.

The driver circuit may contain an electronic ballast for converting an external power source to a high frequency electric current. The high frequency electricity current may cause an electric arc generating a predetermined range of heat when the first metal pins are not properly inserted in the first socket end. For example, when the first metal pins are close to a metal surface of the light tube bracket, the high frequency current near the metal pins may cause an electric arc that may generate high heat, burn the cap and even bring fire accident.

The leading wire has a protective portion thermally connected to the first metal pin clutching the leading wire. When the predetermined range of heat is applied on the first metal pin, the heat is transmitted to the protective portion and breaking off the protective portion to discontinue the high frequency electric current. For example, the protective portion of the leading wire is separated so that no further high frequency current is transmitted to the metal pin to stop the dangerous electric arc.

In some embodiments, the protective portion of the leading wire is mixed with other portions of the leading wire as an unibody component. In other words, a single leading wire has one end connected to the driver circuit and the other end connected to the metal pin, e.g. one part being clutched by the metal pin.

There are several ways to fix the leading wire to the metal pin. For example, the metal pin is made of a metal tube, and the leading wire is inserted into the metal tube. A pressing force is applied at a position of the metal tube to change shape of the metal tube at the position to contact and seize the leading wire. Glue or welding or other methods may be applied to fix the metal pin to the leading wire.

In addition, the leading wire may be an alloy metal wire breaking off when the predetermined range of heat is applied on the first metal pin. In some cases, the leading wire may include multiple sub-wires of different material wounded as a wire.

In some embodiments, the protective portion of the leading wire includes more than 50% composition ratio or even more of tin material. Tin material has a low meting point and may be melt when certain amount of heat is applied. When the protective portion of the leading wire containing tin material is melt, the leading wire is broken into two parts and high frequency electric current is broken. The high frequency electric current may reach 5,000 Hz or even 20,000 Hz, easily causing electric arc when the LED tube apparatus is not installed properly. By breaking off supplying the high frequency electric current to the metal pin, the dangerous electric arc may be stopped for safety.

In some embodiments, the protective portion of the leading wire may include flux material with smaller surface tension than tin material. With the flux material, the protective portion of the leading wire may be broken off more completely due to surface tension.

In some other embodiments, the leading wire may include a first segment, a second segment and a third segment. The composition of the second segment is different from the first segment and the second segment. The second segment is the protective portion. The first segment has a portion clutched by the first metal pin, the third segment is connected to the external end of the driver circuit.

In addition, a leading plate may be disposed for connecting the first segment, the second segment and the third segment. For example, the first segment is riveted to the second segment on the leading plate, the second segment is riveted to the third segment on the leading plate. Certain metal rivet components may be used for connecting multiple segments of wires to form the leading wire. The leading plate may be part of the circuit board for mounting the driver circuit or a separate board. The leading board may be made of metal or plastic material that is easy to transmit heat.

In some embodiments, the leading plate is thermally connected to the first metal pin.

In some embodiments, the leading plate is thermally connected to the first cap. As mentioned above, dangerous electric arc may occur at the metal pin. The heat may burn the first cap, particularly when the first cap is made of plastic material when more than the predetermined range of heat is applied.

In some embodiments, the leading plate has a rough surface for capturing liquidized portion of the second segment of the leading wire to enhance break-off of the second segment. For example, certain protruding structures, or micro holes providing surface sticking force may help receive the melt material to ensure the protective portion melt as separate parts kept with a sufficient distance.

In some embodiments, the protective portion may have more than one breaking-off points. When any of the breaking-off point is broken off, the high frequency electric current is discontinued. Such configuration may further ensure safety to prevent any breaking-off point not function normally or to respond dangerous heat from different positions.

In some embodiments, the protective portion is closer to the metal pin than to the external end of the driver circuit. The cap close to the metal pin that may cause electric arc generating heat is a dangerous object to be taken care of, and it would be better in some embodiments to place the protective portion closer to the metal pin than to the external end of the driver circuit.

In some embodiments, the two first pins may share the same protective portion of the leading wire. For example, in some driver circuit design, the two metal pins are electrically connected to the same terminal end. In such case, the two metal pins may share the same protective portion of the leading wire. In some other cases, the driver circuit may be routed to form a protective portion that may be melt for break-off when undesired heat is transmitted to melt the protective portion.

In some embodiments, heat dissipating material is applied on a thermal path from the metal pin to the protective portion of the leading wire, so that the protective portion responds more quickly to break off when undesired situation occurs.

In some embodiments, the first cap has one or more than one cavities on the first top surface. Air may be passing through to enhance heat dissipation. Furthermore, when the cap is heated by undesired electric arc, the shape of the cap is distorted. With such cavity, the distorted cap may still be kept a certain shape, preventing the LED tube falling down directly from the ceiling, which may cause undesired safety issue.

In some embodiments, heat generated on the first metal pin is transmitted to the tube body, to be able to operate normally for minor and sudden electric arc situation.

In some embodiments, the elongated containing space may be filled with heat dissipating gas. In some cases, the heat dissipation gas may include oxygen gas to protect the LED module.

In some embodiments, the first metal pin may be made of a material that may be melt to break off under the predetermined range of heat.

DETAILED DESCRIPTION

Figure 1:
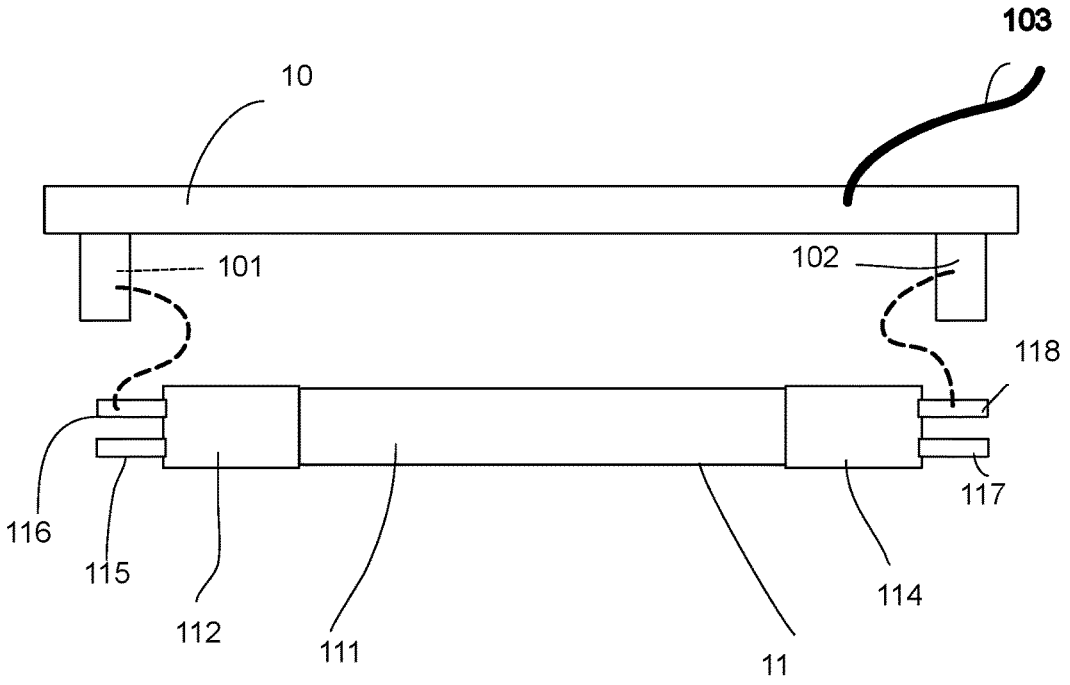
FIG. 1 illustrates an embodiment of an LED tube apparatus.

FIG. 1 illustrates an embodiment of an LED tube apparatus. In FIG. 1, a LED tube apparatus 11 is designed to be installed to a light tube bracket 10. For example, the light tube bracket may be designed for T8 light tube, e.g. compatible for traditional fluorescent light tube and also for installing the LED tube apparatus mentioned below.

The light tube bracket 10 has a first socket end 101 and a second socket end 102. The first socket end 101 and the second socket end 102 may each have two receiving holes for receiving corresponding first metal pins 115, 116 and the second metal pins 117, 118 of the LED tube apparatus 11. An external power source 103 may be routed into the LED tube apparatus 11 for supplying necessary power.

The LED tube apparatus 11 has a tube body 111, a first cap 112 and a second cap 114. The tube body 111 is fixed to the first cap 112 and the second cap 114 at two opposite ends. The first metal pins 115, 116 are fixed to the first cap, e.g. by riveting.

Figure 2:
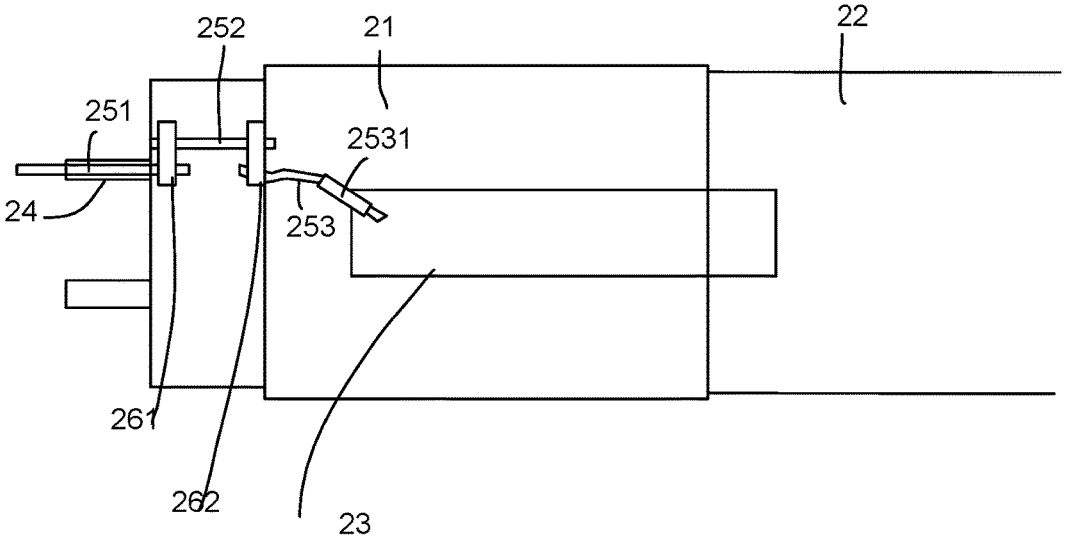
FIG. 2 illustrates components of the LED tube apparatus embodiment.

FIG. 2 illustrates components of the LED tube apparatus embodiment. In FIG. 2, the LED tube embodiment has a tube body 22 (only a portion illustrated) fixed with a first cap 21 at one end. In this embodiment, a leading wire is disposed for routing electricity from the first metal pin 24 to a driver circuit 23. The driver circuit 23 may have an electronic ballast that converts external power source like 110V~220V 50 Hz electricity to high frequency current. The leading wire is mad of a first segment 251, a second segment 252, and a third segment 253. The first segment 251 is clutched by the metal pin 24 to fix the first segment 251 to the first metal pin 24.

The first segment 251 is connected to the second segment 252 by riveting 261. The second segment 252 is connected to the third segment 253 by riveting 262. Welding or other connection method may also be used in other design requirements. The second segment 252 is placed close to the first metal pin 24. When a dangerous electric arc occurs, the heat is transmitted to the second segment 252 and melting the second segment 252 to break off, stopping any further high frequency current provided to the first metal pin 24.

The second segment 252 may be made of tin material, while the first segment 251 and the second segment 253 may be made of inexpensive conductive wire. To prevent undesired contact, an insulation wrapping 2531 may cover part of the third segment 253.

In some embodiments, the riveting 261, 262 may be made on a leading plate. In other words, the first segment 251, the second segment 252 and the third segment 253 are fixed on a leading plate in advance by riveting. The leading plate may be made of heat transmission material to effectively transmit heat from the first cap 21 to the second segment 252 as the protective portion of the leading wire.

Figure 3:
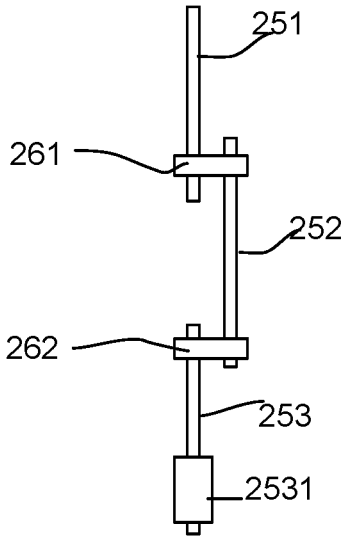
FIG. 3 illustrates a leading wire example.

FIG. 3 illustrates a leading wire example. In FIG. 3, the numerals refer to the same components as appeared in FIG. 2. It is more clearly to see that the leading wire is made of three segments, the first segment 251, the second segment 252, the third segment 253 covered partly with an insulation wrapping 2531. The first segment 251 is connected to the second segment 252 with riveting 261, and the second segment 252 is connected to the third segment 253 with riveting 262.

Figure 4:
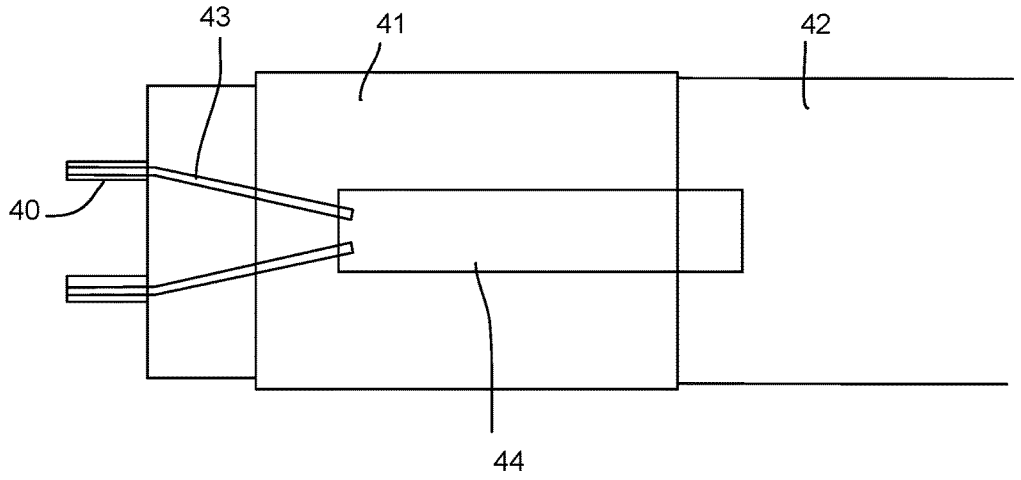
FIG. 4 illustrates another embodiment of an LED tube apparatus.

FIG. 4 illustrates another embodiment of an LED tube apparatus. In this embodiment, the leading wire 43 is made of an alloy wire as an unibody component. The leading wire 43 routes the electricity from the first metal pin 40 to the driver circuit 44. The first cap 41 is fixed to one end of the tube body 42. In such case, the installation is easier. The leading wire 43 may have a specific portion as the protective portion to break off when a predetermined amount of heat is applied on the first metal pin 40. The leading wire 43 may be melt to break off at any point in some other design requirement.

Figure 5:
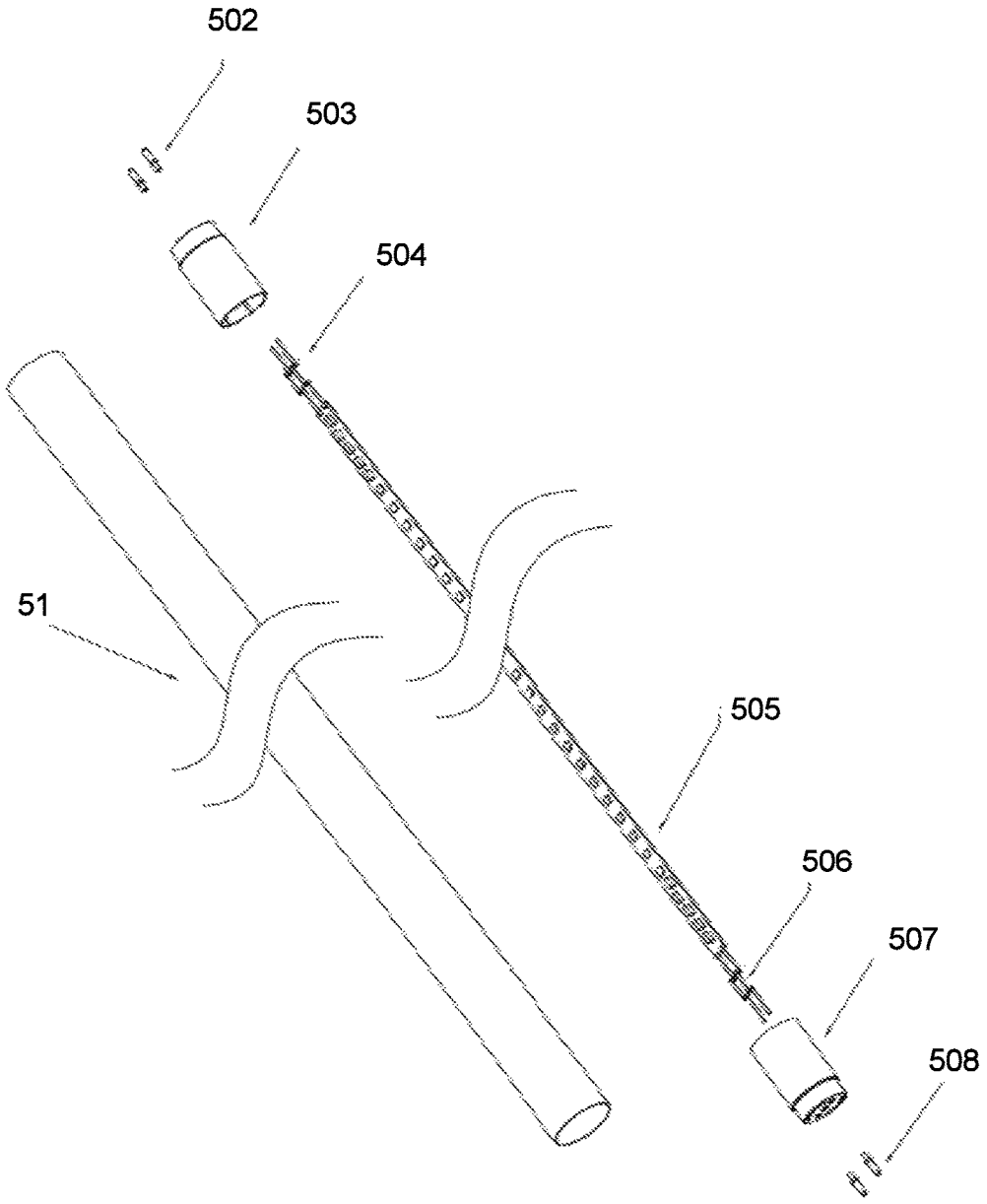
FIG. 5 shows an exploded view of an embodiment of the LED tube apparatus.

FIG. 5 shows an exploded view of an embodiment of the LED tube apparatus. In FIG. 5, the LED tube apparatus includes two first metal pins 502, a first cap 503, two second metal pins 508, a second cap 507 and a tube body 51. The first cap 503 and the second cap 507 are fixed to two opposite ends of the tube body 51. A pair of leading wires 504 are connected to the two first metal pins 502. Another pair of leading wires 506 are connected to the two second metal pins 508. A LED module 505 is connected to the leading wires 506, 508 to receive external power. When certain heat cause abnormal temperature arising, a corresponding protective portion of the leading wires 504, 506 is broken off to prevent accident.

Figure 6:
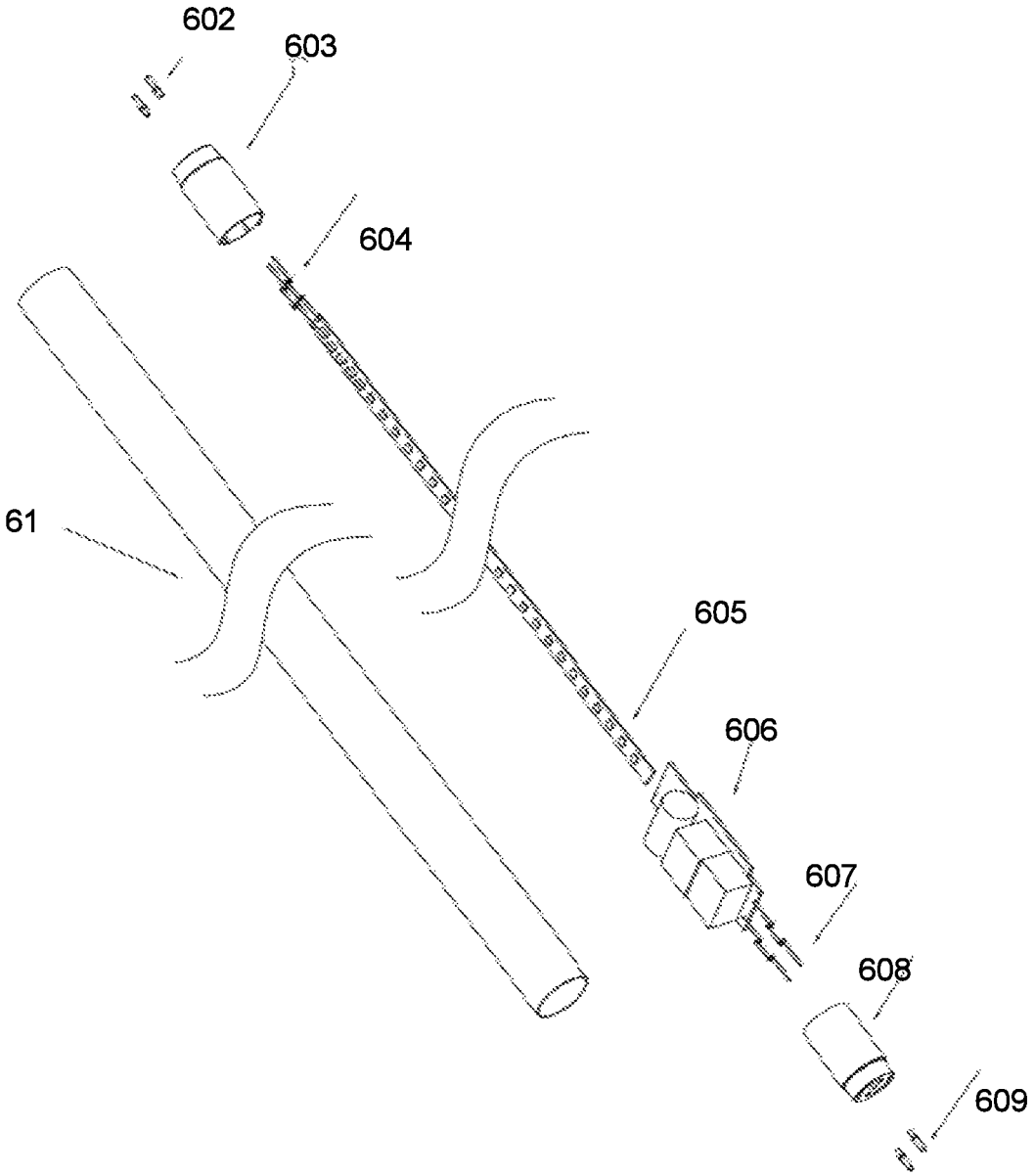
FIG. 6 shows an exploded view of another embodiment of the LED tube apparatus.

FIG. 6 shows an exploded view of another embodiment of the LED tube apparatus. In FIG. 6, similarly, the LED tube apparatus includes a tube body 61 with a first cap 603, a second cap 608 fixed at two ends of the tube body 61. Leading wires 604, 607 are fixed to the metal pins 602, 609 respectively. A LED module 605 includes a driver circuit 606 that contains ballast for generating high frequency current that may cause electric arc if the LED tube apparatus is operated abnormally.

According to an embodiment of the present invention, an LED tube apparatus includes a first cap, a second cap, two first pins, a tube body and an LED module.

The two first pins are riveted on a first top surface the first cap for inserting into a corresponding first socket end of a light tube bracket. At least one of the first metal pins clutches a first end of a leading wire. For example, both the first metal pins separately clutches first ends of leading wires. The configuration may also be applied to the second cap and corresponding second metal pins.

The first metal pins may be made of a metal sheet that is folded as a metal tube. A position of the metal tube may be pressed to seize a part of the leading wire to electrically be connected to the leading wire and to fix the leading wire. In some other embodiments, welding or glues may be used for clutching and fixing the metal pins to the leading wires.

The tube body has two opposite ends respectively fixed to the first cap and the second cap for providing an elongated containing space. For example, the tube body is an elongated round tube made of glass, or the tube body is an elongated round tube made of transparent or translucent plastic material like PC. The first cap and the second cap may be made of plastic material.

The LED module is stored in the elongated containing space for emitting light through a surface of the tube body. The surface of the tube body may be further covered with painting material for light diffusion, preventing glare or for coloring. Fluorescent material may also be used for changing output spectrum of the LED tube apparatus. For example, blue light emitted from LED chips may be converted to green or red light by adding fluorescent material on internal surface of the tube body.

Some heat dissipation material may also be applied on the internal surface of the tube body, particularly when the tube body is made of plastic material, which may be less expensive but may not have well heat dissipation characteristic like glass material. In such case, applying heat dissipation material on internal surface of the tube body may be helpful for enhancing heat dissipation.

The LED module has a driver circuit and an LED array. The driver circuit converts external power source like 110V~220V 50 Hz external current to a driving current supplied to the LED array. The LED array may include multiple LED chips packaged on a transparent substrate, mounted on an aluminum substrate, or any other configuration for emit light passing through the surface of the tube body. More than two types of LED chips with different color temperatures or different colors may be integrated for providing a desired mixed spectrum.

The driver circuit may be mounted on one circuit board, two or more than two circuit boards. In other words, the components of the driver circuit may be distributed in the same place, e.g. near the cap, to prevent affecting light output, or several places. The components of the driver circuit may be placed on the same substrate of the LED chips, or the components of the driver circuit may be kept a distance from the LED chips for meeting different design needs. Components of the driver circuit that generate more heat may be placed closer to the cap for preventing damage of the LED chips. Certain heat sink may be used particularly for components of the driver circuit that generates more heat than other components.

The driver circuit may have two or more external ends for receiving external power source supply. For example, the driver circuit includes an external end connected to a second end of the leading wire.

The driver circuit may contain an electronic ballast for converting an external power source to a high frequency electric current. The high frequency electricity current may cause an electric arc generating a predetermined range of heat when the first metal pins are not properly inserted in the first socket end. For example, when the first metal pins are close to a metal surface of the light tube bracket, the high frequency current near the metal pins may cause an electric arc that may generate high heat, burn the cap and even bring fire accident.

The leading wire has a protective portion thermally connected to the first metal pin clutching the leading wire. When the predetermined range of heat is applied on the first metal pin, the heat is transmitted to the protective portion and breaking off the protective portion to discontinue the high frequency electric current. For example, the protective portion of the leading wire is separated so that no further high frequency current is transmitted to the metal pin to stop the dangerous electric arc.

In some embodiments, the protective portion of the leading wire is mixed with other portions of the leading wire as an unibody component. In other words, a single leading wire has one end connected to the driver circuit and the other end connected to the metal pin, e.g. one part being clutched by the metal pin.

There are several ways to fix the leading wire to the metal pin. For example, the metal pin is made of a metal tube, and the leading wire is inserted into the metal tube. A pressing force is applied at a position of the metal tube to change shape of the metal tube at the position to contact and seize the leading wire. Glue or welding or other methods may be applied to fix the metal pin to the leading wire.

In addition, the leading wire may be an alloy metal wire breaking off when the predetermined range of heat is applied on the first metal pin. In some cases, the leading wire may include multiple sub-wires of different material wounded as a wire.

In some embodiments, the protective portion of the leading wire includes more than 50% composition ratio or even more of tin material. Tin material has a low meting point and may be melt when certain amount of heat is applied. When the protective portion of the leading wire containing tin material is melt, the leading wire is broken into two parts and high frequency electric current is broken. The high frequency electric current may reach 5,000 Hz or even 20,000 Hz, easily causing electric arc when the LED tube apparatus is not installed properly. By breaking off supplying the high frequency electric current to the metal pin, the dangerous electric arc may be stopped for safety.

In some embodiments, the protective portion of the leading wire may include flux material with smaller surface tension than tin material. With the flux material, the protective portion of the leading wire may be broken off more completely due to surface tension.

In some other embodiments, the leading wire may include a first segment, a second segment and a third segment. The composition of the second segment is different from the first segment and the second segment. The second segment is the protective portion. The first segment has a portion clutched by the first metal pin, the third segment is connected to the external end of the driver circuit.

In addition, a leading plate may be disposed for connecting the first segment, the second segment and the third segment. For example, the first segment is riveted to the second segment on the leading plate, the second segment is riveted to the third segment on the leading plate. Certain metal rivet components may be used for connecting multiple segments of wires to form the leading wire. The leading plate may be part of the circuit board for mounting the driver circuit or a separate board. The leading board may be made of metal or plastic material that is easy to transmit heat.

In some embodiments, the leading plate is thermally connected to the first metal pin.

In some embodiments, the leading plate is thermally connected to the first cap. As mentioned above, dangerous electric arc may occur at the metal pin. The heat may burn the first cap, particularly when the first cap is made of plastic material when more than the predetermined range of heat is applied.

In some embodiments, the leading plate has a rough surface for capturing liquidized portion of the second segment of the leading wire to enhance break-off of the second segment. For example, certain protruding structures, or micro holes providing surface sticking force may help receive the melt material to ensure the protective portion melt as separate parts kept with a sufficient distance.

In some embodiments, the protective portion may have more than one breaking-off points. When any of the breaking-off point is broken off, the high frequency electric current is discontinued. Such configuration may further ensure safety to prevent any breaking-off point not function normally or to respond dangerous heat from different positions.

In some embodiments, the protective portion is closer to the metal pin than to the external end of the driver circuit. The cap close to the metal pin that may cause electric arc generating heat is a dangerous object to be taken care of, and it would be better in some embodiments to place the protective portion closer to the metal pin than to the external end of the driver circuit.

In some embodiments, the two first pins may share the same protective portion of the leading wire. For example, in some driver circuit design, the two metal pins are electrically connected to the same terminal end. In such case, the two metal pins may share the same protective portion of the leading wire. In some other cases, the driver circuit may be routed to form a protective portion that may be melt for break-off when undesired heat is transmitted to melt the protective portion.

In some embodiments, heat dissipating material is applied on a thermal path from the metal pin to the protective portion of the leading wire, so that the protective portion responds more quickly to break off when undesired situation occurs.

In some embodiments, the first cap has one or more than one cavities on the first top surface. Air may be passing through to enhance heat dissipation. Furthermore, when the cap is heated by undesired electric arc, the shape of the cap is distorted. With such cavity, the distorted cap may still be kept a certain shape, preventing the LED tube falling down directly from the ceiling, which may cause undesired safety issue.

In some embodiments, heat generated on the first metal pin is transmitted to the tube body, to be able to operate normally for minor and sudden electric arc situation.

In some embodiments, the elongated containing space may be filled with heat dissipating gas. In some cases, the heat dissipation gas may include oxygen gas to protect the LED module.

In some embodiments, the first metal pin may be made of a material that may be melt to break off under the predetermined range of heat.

In addition to the above-described embodiments, various modifications may be made, and as long as it is within the spirit of the same invention, the various designs that can be made by those skilled in the art are belong to the scope of the present invention.

The invention claimed is:

1. An LED tube apparatus, comprising:

a first cap;

two first metal pins riveted on a first top surface the first cap for inserting into a corresponding first socket end of a light tube bracket, at least one of the first metal pins clutching a first end of a leading wire;

a second cap;

two second metal pins riveted on a second top surface of the second cap for inserting into a corresponding second socket end of the light tube bracket;

a tube body with two opposite ends respectively fixed to the first cap and the second cap for providing an elongated containing space; and an LED module stored in the elongated containing space for emitting light through a surface of the tube body, the LED module having a driver circuit with an external end connected to a second end of the leading wire, the driver circuit containing an electronic ballast for converting an external power source to a high frequency electric current, the high frequency electricity current causing an electric arc generating a predetermined range of heat when the first metal pins are not properly inserted in the first socket end;

wherein the leading wire has a protective portion thermally connected to the first metal pin clutching the leading wire, when the predetermined range of heat is applied on the first metal pin, the heat is transmitted to the protective portion and breaking off the protective portion to discontinue the high frequency electric current.

2. The LED tube apparatus of claim 1, wherein the protective portion of the leading wire is mixed with other portions of the leading wire as an unibody component.

3. The LED tube apparatus of claim 1, wherein the leading wire is an alloy metal wire breaking off when the predetermined range of heat is applied on the first metal pin.

4. The LED tube apparatus of claim 1, wherein the protective portion of the leading wire comprises more than 50% composition ratio of tin material.

5. The LED tube apparatus of claim 4, wherein the protective portion of the leading wire comprises flux material with smaller surface tension than tin material.

6. The LED tube apparatus of claim 1, wherein the leading wire comprises a first segment, a second segment and a third segment, the composition of the second segment is different from the first segment and the second segment, the second segment is the protective portion, the first segment has a portion clutched by the first metal pin, the third segment is connected to the external end of the driver circuit.

7. The LED tube apparatus of claim 6, further comprising a leading plate for connecting the first segment, the second segment and the third segment.

8. The LED tube apparatus of claim 7, wherein the first segment is riveted to the second segment on the leading plate, the second segment is riveted to the third segment on the leading plate.

9. The LED tube apparatus of claim 7, wherein the leading plate is thermally connected to the first metal pin.

10. The LED tube apparatus of claim 7, wherein the leading plate is thermally connected to the first cap, the first cap is made of plastic material and burnt when more than the predetermined range of heat is applied.

11. The LED tube apparatus of claim 7, wherein the leading plate has a rough surface for capturing liquidized portion of the second segment of the leading wire to enhance break-off of the second segment.

12. The LED tube apparatus of claim 1, wherein the protective portion has more than one breaking-off points, when any of the breaking-off point is broken off, the high frequency electric current is discontinued.

13. The LED tube apparatus of claim 1, wherein the protective portion is closer to the metal pin than to the external end of the driver circuit.

14. The LED tube apparatus of claim 1, wherein the two first pins share the same protective portion of the leading wire.

15. The LED tube apparatus of claim 1, further comprising heat dissipating material applied on a thermal path from the metal pin to the protective portion of the leading wire.

16. The LED tube apparatus of claim 1, wherein the first cap has a cavity on the first top surface.

17. The LED tube apparatus of claim 1, wherein heat generated on the first metal pin is transmitted to the tube body.

18. The LED tube apparatus of claim 1, wherein the elongated containing space is filled with heat dissipating gas.

19. The LED tube apparatus of claim 1, wherein the heat dissipation gas comprises oxygen gas.

20. The LED tube apparatus of claim 1, wherein the first metal pin is broken off under the predetermined range of heat.

* * * * *